US007539449B2

(12) United States Patent
Aoki

(10) Patent No.: US 7,539,449 B2
(45) Date of Patent: May 26, 2009

(54) IMAGE HEATING APPARATUS

(75) Inventor: Kazuaki Aoki, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 248 days.

(21) Appl. No.: 11/470,793

(22) Filed: Sep. 7, 2006

(65) Prior Publication Data

US 2007/0212134 A1 Sep. 13, 2007

(30) Foreign Application Priority Data

Sep. 13, 2005 (JP) ..... 2005-265420

(51) Int. Cl.
*G03G 15/20* (2006.01)

(52) U.S. Cl. ..... 399/320; 399/328; 399/329; 399/67; 399/122; 219/216

(58) Field of Classification Search ..... 399/122, 399/320, 328, 327, 400, 33, 67, 68; 219/216; 492/25

See application file for complete search history.

(56) References Cited

U.S. PATENT DOCUMENTS 5,048,572 A * 9/1991 Levine ..... 138/121
5,740,513 A * 4/1998 Matsuo et al. ..... 399/333
5,752,148 A * 5/1998 Yoneda et al. ..... 399/329
5,822,669 A * 10/1998 Okabayashi et al. ..... 399/330
5,879,752 A * 3/1999 Murakami et al. ..... 427/466
6,137,985 A * 10/2000 Kinouchi et al. ..... 399/329
6,449,457 B2 * 9/2002 Samei et al. ..... 399/328
6,577,839 B2 * 6/2003 Samei ..... 399/328
6,591,082 B2 * 7/2003 Samei et al. ..... 399/329
6,725,009 B1 * 4/2004 Tatematsu et al. ..... 399/329
6,810,230 B2 * 10/2004 Imai et al. ..... 399/328
6,819,904 B2 * 11/2004 Terada et al. ..... 399/328
6,872,925 B2 * 3/2005 Asakura et al. ..... 219/619
7,212,775 B2 * 5/2007 Kachi ..... 399/329
7,299,003 B2 * 11/2007 Kurotaka et al. ..... 399/329
7,390,995 B2 * 6/2008 Hasegawa et al. ..... 219/619

FOREIGN PATENT DOCUMENTS

JP 10-69208 3/1998
JP 2004-341346 12/2004

* cited by examiner

*Primary Examiner*—David M Gray
*Assistant Examiner*—G. M. Hyder
(74) *Attorney, Agent, or Firm*—Fitzpatrick, Cella, Harper & Scinto

(57) ABSTRACT

A fixing apparatus 50 capable of reducing noise during a fixing operation using a fixing belt 1 having a metal layer includes the fixing belt 1 stretched between a fixation roller 2 and a fixation tension roller 3. The fixing apparatus 50 further includes a coil **4*b* which is disposed opposite from the fixation tension roller 3 via the fixing belt 1 and is supplied with an AC (600 V, 25 kHz at maximum) by an IH controller 10, so that the fixing belt 1 and the fixation tension roller 3 are simultaneously heated by induction heating. In the fixing apparatus 50, insulating belt flanges 25*a* and 25*b* are attached to the fixation tension roller 3 at both end portions of the fixation tension roller 3 to limit movement of the fixing belt 1 in a width direction of the fixing belt 1**.

8 Claims, 6 Drawing Sheets

(a) CREOSS-SECTION (b) EQUIVALENT CIRCUIT

IMAGE HEATING APPARATUS

FIELD OF THE INVENTION AND RELATED ART

The present invention relates to an image heating apparatus for heating an image on a recording material. As the image heating apparatus, it is possible to use, e.g., a fixing apparatus for fixing an unfixed image formed on a recording material or a gloss-imparting apparatus for improving gloss of an image fixed on a recording material by heating the image.

An image forming apparatus for fixing a toner image on a recording material by circulating a heated fixing belt to contact the recording material onto which the toner image is transferred has been put into practical use. The fixation roller can realize a long heating length of the recording material by a relatively small apparatus structure similarly as in the case of using a large diameter fixation roller.

Japanese Laid-Open Patent Application (JP-A) 2004-341346 has disclosed an image forming apparatus in which a recording material is nipped and conveyed between a fixing belt and a pressure belt which are circularly driven while being pressed against each other to fix a toner image on the recording material. In the image forming apparatus, the fixing belt is heated by stretching the fixing belt around a heating roller provided with a heater at its central axis. The pressure belt is also heated by being circulated in contact with the heated fixing belt.

JP-A Hei 10-69208 has disclosed an image forming apparatus in which a fixing belt is heated by an induction heating (IH) method. In the image forming apparatus, a coil member is disposed opposite to an inner peripheral surface of the fixing belt having a metal layer. The fixing belt is induction-heated to be kept at a predetermined temperature range by applying a high-frequency current to the coil member to generate magnetic flux so as to be exerted on the fixing belt.

In the fixing apparatus using the fixing belt, it is necessary to prevent lateral deviation or dislodgement of the fixing belt by attaching a belt regulation member (so-called collar) at both end portions of a roller for stretching the fixing belt. Even in the case of employing a method wherein the lateral deviation of the fixing belt is prevented by detecting a position of the fixing belt in its width direction to control a degree of inclination of the roller, it is also necessary to employ the belt regulation member as a member for regulating the lateral deviation.

However, in the case where the fixing apparatus in which the fixing belt having the metal layer is stretched around the roller provided with the metal-made belt regulation member is operated, it has been found that large electromagnetic noise, radio wave, power supply ripple are caused to occur due to electromotive force generated in the fixing belt when a contact surface of the fixing belt with the roller is not electrically insulated. Particularly, it is difficult to ensure an electrical insulation distance between the fixing belt and the roller end portion.

SUMMARY OF THE INVENTION

An object of the present invention is to provide an image heating apparatus, for heating an image on a recording material by causing a belt member having an electroconductive layer to generate heat through induction heating, capable of reducing electromagnetic noise or the like generated by a potential difference caused between the belt member and a guide member for guiding the belt member.

According to an aspect of the present invention, there is provided an image heating apparatus, comprising:

magnetic flux generation means for generating magnetic flux;

a belt member having an electroconductive layer for generating heat by magnetic flux from the magnetic flux generation means, the belt member heating an image on a recording material; and a guide member which comprises a regulation portion for guiding said belt member while regulating movement of the belt member in a width direction of the belt member and comprises an electroconductive portion electrically insulated from the electroconductive layer, the electroconductive portion having an end surface which is electrically insulated at a position inside a regulation position at which the belt member is regulated by the regulation portion.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Hereinbelow, a fixing apparatus 50 as an embodiment of the present invention and a color electrophotographic printer 100 including the fixing apparatus 50 will be described with reference to the drawings. Incidentally, the fixing apparatus in the present invention is not limited to one using a fixing belt 1 and a pressure belt 2 as in this embodiment but may also be applicable to various fixing apparatuses including a fixing belt, having an electroconductive layer, for effecting induction heating, such as a fixing apparatus using a fixing belt and a fixation roller, a fixing apparatus for effecting only heating using a fixing belt without effecting pressure application, etc.

Figure 1:
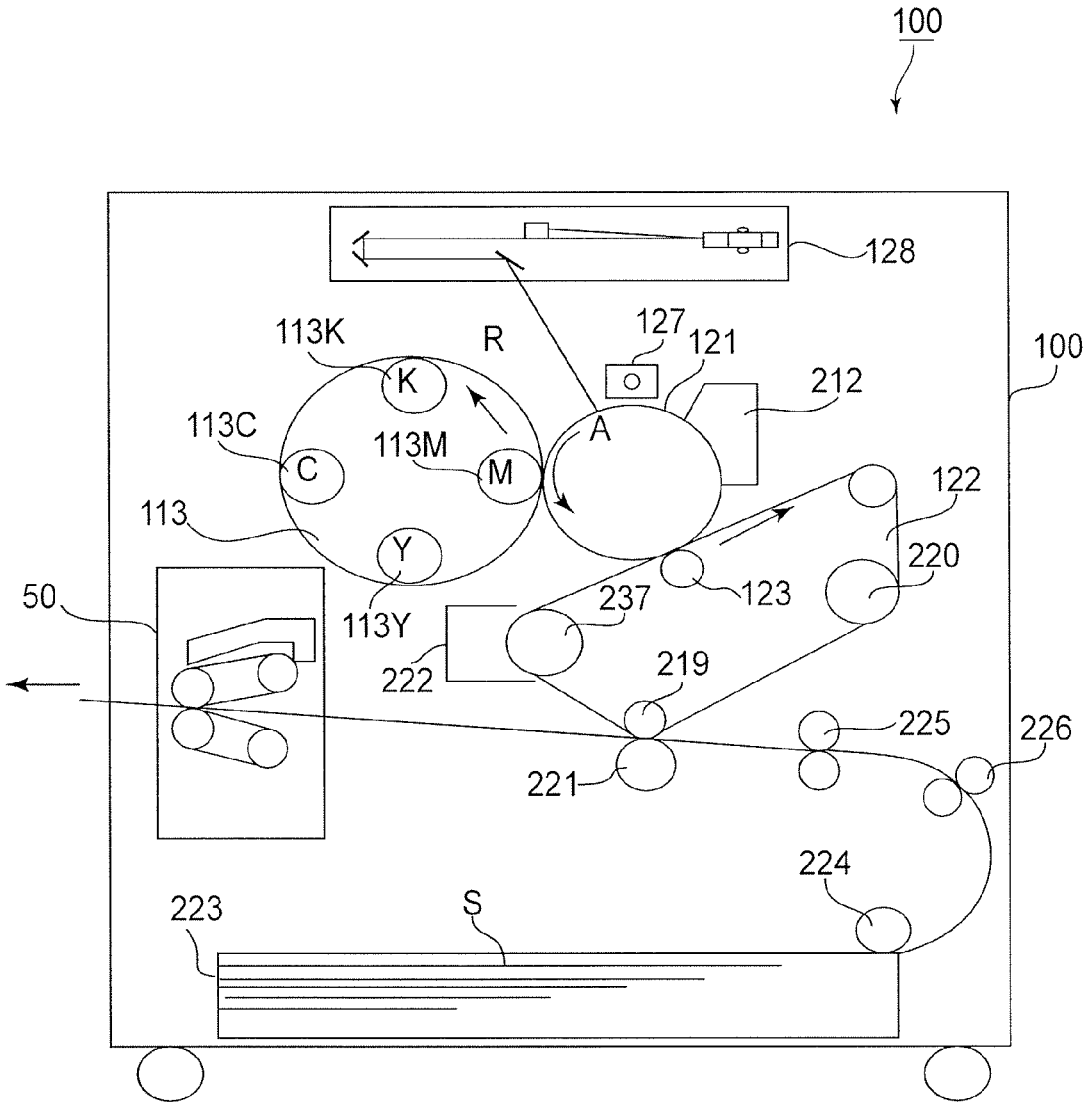
FIG. 1 is a schematic view for illustrating a constitution of a color electrophotographic printer as an embodiment of an image forming apparatus according to the present invention.
Figure 2:
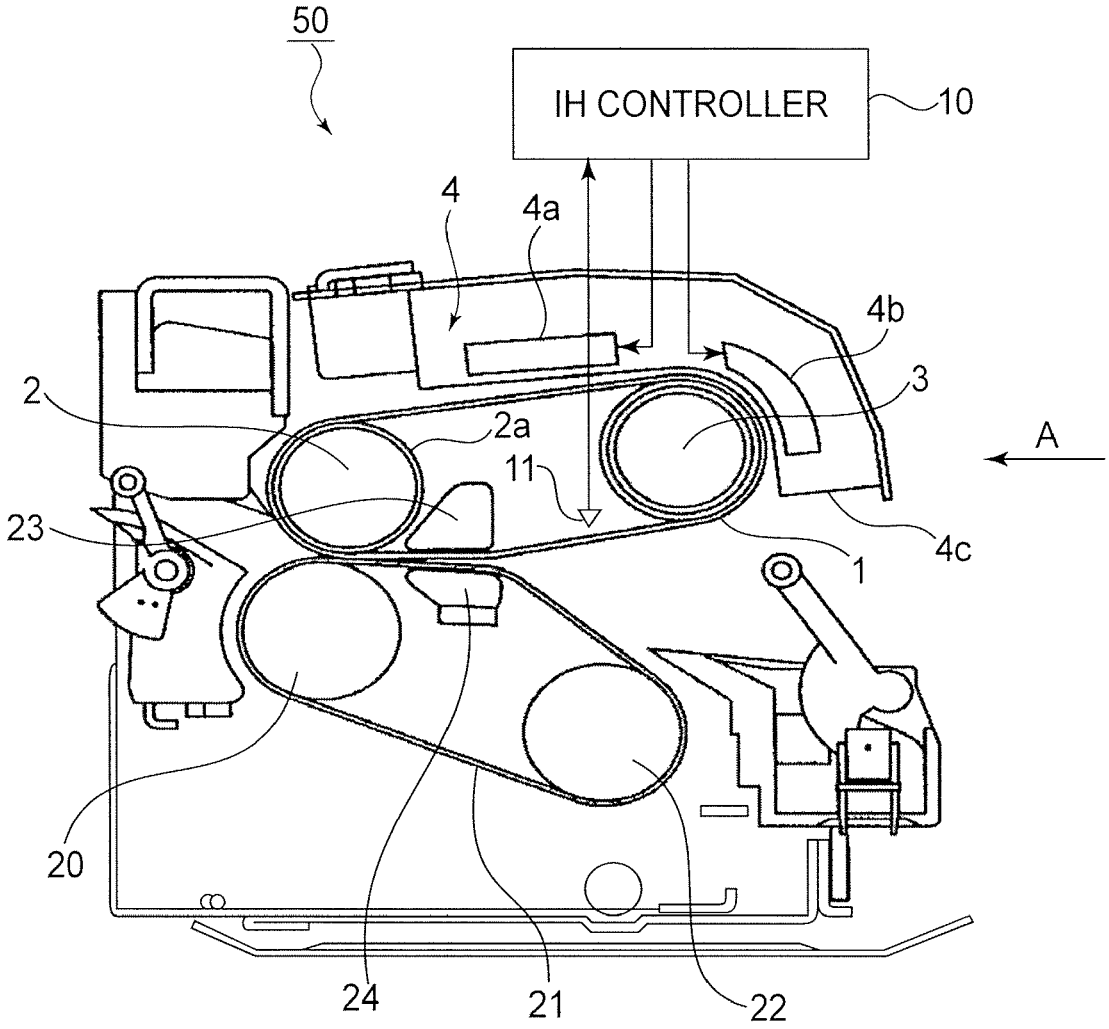
FIG. 2 is a schematic view for illustrating a constitution of a fixing apparatus as an embodiment of an image heating apparatus according to the present invention.

A fixing apparatus 50 (as shown in FIGS. 1 and 2) of this embodiment may also be incorporated into image forming apparatuses, other than a color electrophotographic printer 100 in this embodiment, such as a monochromatic copying machine, a facsimile apparatus, a monochromatic printer, and a multifunction machine which combines their functions.

Further, the fixing apparatus 50 and the color electrophotographic printer 100 in this embodiment are not limited to those employing combinations of constitutional members described below but may also be realized in other embodiments in which the constitutional members are partly or entirely replaced with their alternative members.

<Image Forming Apparatus>

FIG. 1 is an explanatory view for the color electrophotographic printer 100 as an embodiment of the image forming apparatus according to the present invention.

Referring to FIG. 1, in the color electrophotographic printer 100, a toner image which has been primary-transferred onto an intermediary transfer belt 122 is secondary-transferred onto a sheet S and then the sheet S is conveyed in the fixing apparatus 50, where the toner image is fixed on the sheet S as a recording material as a recording material. Example of the sheet S on which the toner image is transferred and fixed may include plain paper, thick paper, a transparent sheet, envelop, etc. The sheet S is fed to the color electrophotographic printer 100 through a paper (sheet) feeding cassette 223 or an unshown paper feeding tray.

The color electrophotographic printer 100 includes a developing device 113 for colors of yellow (Y), magenta (M), cyan (C), and black (Bk). The developing device 113 includes a developing roller 113Y for Y (yellow), a developing roller 113M for M (magenta), a developing roller 113C for C (cyan), and a developing roller 113Bk for Bk (black). The respective developing rollers are moved to a position at which an associated developing roller contacts a photosensitive drum 121 as an image bearing member and develops an electrostatic latent image with toner of an associated color (Y, M, C or Bk) on the surface of the photosensitive drum 121.

Around the photosensitive drum 121, members including a primary charger 127, the developing device 113, a primary transfer device 123, and a cleaning apparatus 212 are disposed and subjected to formation and development of the electrostatic latent image by the rotation of the photosensitive drum in the following manner.

First, the surface of the photosensitive drum 121 cleaned by the cleaning apparatus 212 is electrically charged in a uniformly charged state by the primary charger 127. At the surface of the photosensitive drum 121 placed in the uniformly charged state, scanning with a laser beam modulated by an image signal is effected by a laser scanner 128. By the scanning exposure, on the surface of the photosensitive drum 121, electrostatic latent images for the respective colors are successively formed.

The respective electrostatic latent images are developed with associated color toners, respectively, by the developing device 113 to provide color toner images. A first toner image formed on the surface of the photosensitive drum 121 is primary-transferred onto the intermediary transfer belt 122 by the primary transfer device 123. Thereafter, a toner image of a subsequent color is formed on the surface of the photosensitive drum 121 and is superposed on the first toner image transferred on the intermediary transfer belt 122, in such a state that leading ends of the toner images are aligned with each other, in the same manner as in the case of the first toner image. The remaining two color toner images are also superposed on the previous color toner images on the intermediary transfer belt 122 in the same manner. As a result, on the intermediary transfer belt 122, a full-color toner image (including the four color toner images) is formed.

The thus formed full-color toner image formed on the intermediary transfer belt 122 is then a secondary-transferred onto the sheet S by a secondary transfer roller 221. Before the secondary transfer, the sheet S is fed from the paper feeding cassette 223 one by one by means of the paper feeding roller 224. The sheet S is placed in a stand-by state after subjected to correction of skew feeding by a pair of registration rollers 225. The pair of registration rollers 225 feeds the sheet S to a nip between the secondary transfer roller 221 and a separation roller 219 at timing in synchronism with the full-color toner image transferred onto the intermediary transfer belt 122. The sheet S onto which the full-color toner image is transferred by the secondary transfer roller 221 is conveyed into the fixing apparatus 50, where the toner image is fixed on the sheet S.

<Fixing Apparatus>

Figure 3:
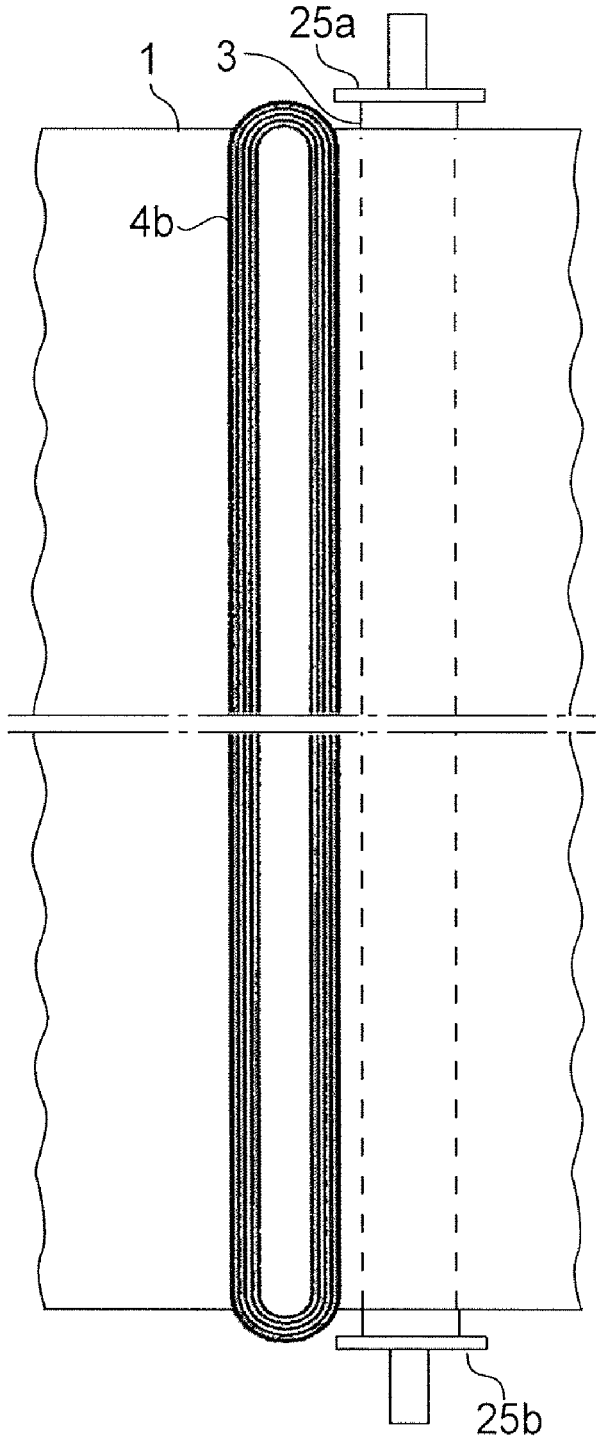
FIG. 3 is a schematic view for illustrating a positional relationship between a fixation tension roller and a fixing belt.

FIG. 2 is an explanatory view of a constitution of a fixing apparatus as an embodiment of the fixing apparatus 50 as the image heating apparatus of the present invention, and FIG. 3 is an explanatory view of a positional relationship between the fixation tension roller and the pressure belt.

Referring to FIG. 2, the fixing apparatus 50 includes a fixing belt 1, as a belt member, contactable with a toner image transfer surface of the sheet S while being kept at a high temperature and the pressure belt 21, contactable with a back surface of the sheet S, for pressing the sheet S against the fixing belt 1. The fixing belt 1 and the pressure belt 12 are assembled so that they can be pressed against and moved away from each other. More specifically, the belts 1 and 21 are circularly moved together in a contact state under pressure during passing of the sheet S and are circularly moved individually in a separation state during standby of the sheet S.

The fixing belt 1 is a belt member extended under tension around a fixation roller 2 for rotationally driving the fixing belt 1 and a fixation tension roller 3, for stretching the fixing belt 1, as a heat source.

Figure 6:
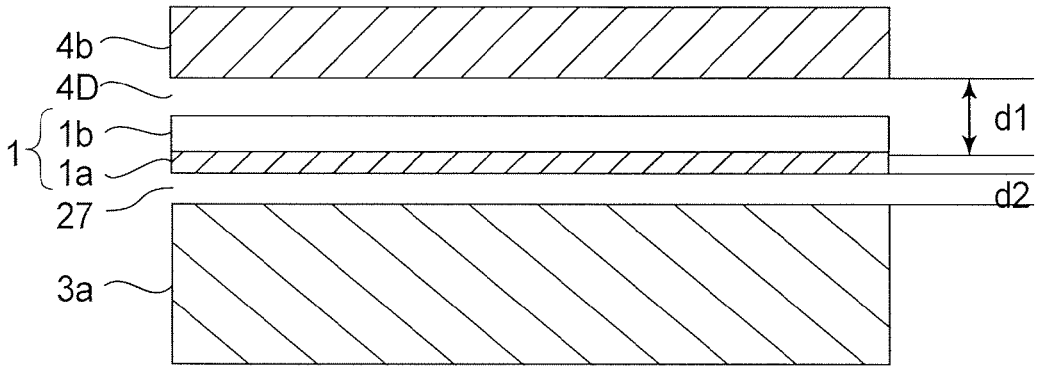
FIGS. 6(*a*) and 6(*b*) are schematic views for illustrating induced voltage of a fixing belt.
Figure 6:
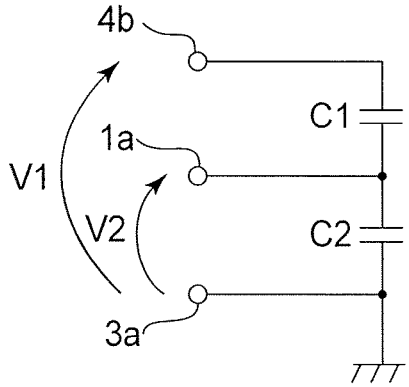

The fixing belt 1 has a 100 μm-thick base layer of nickel (1*a* in FIG. 6(*a*)) as an electroconductive member and a 400 μm-thick elastic layer disposed at an outer peripheral surface of the base layer.

As a material for the elastic layer, it is also possible to use other known elastic materials such as silicone rubber, fluorine-containing rubber and the like. In this embodiment, silicone rubber is used.

The fixation roller 2 is an elastic roller prepared by providing a silicone rubber layer 2*a* as an elastic layer on a surface of a core metal of iron alloy having an outer diameter of 20 mm and an inner diameter of 18 mm. By providing the elastic layer to the outer peripheral surface of the core metal, a friction transmission force is created, so that a driving force inputted from an unshown drive source via a drive gear train can be effectively transmitted to the fixing belt 1. By the silicone rubber layer 2*a*, an amount of heat conduction (transfer) to the core metal is decreased and a warm-up time is also effectively reduced.

The fixation tension roller 3 as a guide member for guiding the fixing belt 1 is an iron-made hollow roller (electroconductive portion), as an electroconductive member, having an outer diameter of 20 mm, an inner diameter of 18 mm, and a thickness of 1 mm, and is biased outwardly by an unshown stretching spring disposed at an axis end portion to apply tension to the fixing belt 1.

The fixing apparatus 50 further includes an induction heating (IH) unit 4 as a coil member for induction heating. The IH unit 4 is constituted by supporting two coils 4*a* and 4*b* in an electrical insulation manner. The coil 4*a* is disposed opposite to a flat portion of the fixing belt 1 (endless belt) as a member to be heated so as to exclusively heat the electroconductive layer of the fixing belt 1 by induction heating. The coil 4*b* is disposed opposite to the fixation tension roller 3 via the fixing belt 1 so as to induction-heat the electroconductive layer of the fixing belt 1 and the electroconductive portion of the fixation tension roller 3. The IH unit 4 has an opposite surface along an outer shape of the fixation tension roller 3, and a distance between the fixing belt 1 and the coils 4*a* and 4*b* is set to about 1.5 mm.

On the other hand, the pressure belt 2 is stretched around a metal pressure roller 20 as a pressing member and a pressure tension roller 22. The pressure roller 20 is rotated by mechanical power transmission from the fixation roller 2 even in such a state that it is moved away from the fixation roller 2. During the fixing operation, the pressure roller 20 is pressed against the fixation roller 2 at a pressing force of 300N. The pressure belt 21 is formed of the same material as the fixing belt 1. The pressure tension roller 22 is biased outwardly by an unshown stretching spring to apply tension to the pressure belt 21.

A fixation stay 23 formed of stainless steel (SUS material) is fixed on a fixation frame (not shown) so as to support the fixing belt from the back side of the fixing belt 1. A silicone rubber-made pressure pad 24 disposed opposite to the fixation stay 23 via the fixing belt 1 and the pressure belt 21 presses a nip, between the fixing belt 1 and the pressure belt 21, against the fixation stay 23 to apply a pressing force of 500N to the fixation stay 23.

An IH controller 10 supplies a triangular wave (AC 600 V, 25 kHz at maximum output) to the IH unit 4, so that magnetic flux is generated in the coils 4*a* and 4*b* to heat the fixing belt 1 and the fixation tension roller 3. The IH controller 10 increases and/or decreases its output on the bias of an output of a temperature sensor (thermistor) disposed at a central portion of the fixing belt 1 and downstream from the fixation tension roller 3, thus adjusting the temperature of the fixing belt 1 to 180° C. On the other hand, the pressure belt 21 is temperature-controlled to appropriately 100° C. by a heater (not shown) provided in the pressure roller 20.

During the fixation operation, the pressure belt 21 is raised and pressed against the fixing belt 1, so that a long pressure contact surface from the nip between the fixation roller 2 and the pressure roller 20 to the end portion of opposing surface between the fixation stay 23 and the pressure pad 24 is formed between the fixing belt 1 and the pressure belt 21. At the long pressure contact surface, when the sheet S on which the unfixed toner image is electrostatically adsorbed is supplied, nipped, and conveyed, the toner image subjected to application of heat and pressure is fixed on the sheet S.

FIG. 3 shows a positional relationship between the fixation tension roller 3 and the fixing belt 1 viewed in an arrow A direction of FIG. 2, wherein the fixing belt 1 is developed. As shown in FIG. 3, at both ends of the elongated fixation tension roller 3 adapted to A3-size sheet, belt flanges 25*a* and 25*b* as a regulation portion for regulating movement of the fixing belt 1 in a width direction thereof and are rotated by the rotation of the fixation tension roller 3. The belt flange 25*a* and 25*b* are set to have a diameter larger than that of the fixation tension roller 3 and are fixed at positions with a certain distance from a center position of the fixing belt 1, so that excessive outward deviation of position of the fixing belt 1 from an ordinary operation position is prevented.

As a material of the belt flanges 25*a* and 25*b*, a plastic material having a high heat resistance and a high sliding performance is used. By the belt flanges 25*a* and 25*b*, the fixing belt 1 is configured to be regulated in its deviation direction.

In the fixing apparatus 50 of this embodiment, the fixation tension roller 3 has a hollow roller 3*a* as a heat generation portion for generating heat by the action of magnetic flux from the coil 4*b*. Accordingly, cooling of the fixing belt 1 can be avoided by heat accumulation of the fixation tension roller 3, so that it is possible to ensure a sufficient temperature at the fixation nip without heating the fixing belt 1 up to high temperatures. Further, it is also not necessary to provide the fixation tension roller 3 with an additional heat means.

First Embodiment

Figure 4:
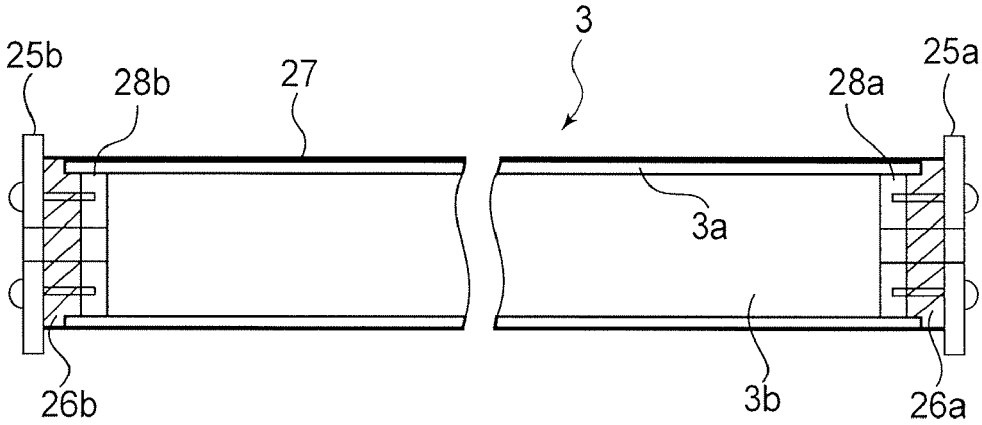
FIG. 4 is a schematic view for illustrating a structure of a fixation tension roller in First Embodiment.

FIG. 4 shows a structure of a fixation tension roller 3 in First Embodiment. Referring to FIG. 4, the fixation tension roller 3 includes an iron hollow roller 3*a* having an outer diameter of 20 mm, an inner diameter of 18 mm, and a thickness of 1 mm and metal-made end plates 28*a* and 28*b*, disposed at both end portions of the hollow roller 3*a*, for attaching thereto an axis of the hollow roller 3*a*. To the end plates 28*a* and 28*b*, the belt flanges 25*a* and 25*b* are fixed by screws through 3 mm-thick circular insulating members 26*a* and 26*b* which have the substantially same outer diameter as the fixation tension roller 3 and are formed of heat-resistant resin. Into central openings of the end plates 28*a* and 28*b*, a rotation axis (shaft) of the fixation tension roller 3 is fixedly inserted. Further, a 50 μm-thick heat-shrinkable tube 27 (of PFA) as an insulating member is inserted so as to integrally cover the outer peripheral surfaces of the fixation tension roller 3 and the circular insulating members 26*a* and 26*b* and heated to be brought into close contact with thereto. The heat-shrinkable tube 27 is the insulating member, so that when the magnetic flux from the coil 4*b* shown in FIG. 3 acts on the fixation tension roller 3, independent eddy currents are generated in the nickel layer 1*a* (FIG. 6) of the fixing belt 1 stretched around the tube 27 and in the pipe wall of the hollow roller 3*a* inside the tube 27.

As a result, it is possible to realize resistance heating, with high reproducibility, such that passage of current between the nickel layer 1*a* (FIG. 6) of the fixing belt 1 and the pipe wall of the hollow roller 3*a* is obviated. Further, when the fixing belt 1 is laterally deviated, an edge of the fixing belt 1 contacts the fixing belt 25*a* or 25*b*. However, the belt flanges 25*a* and 25*b* have surface insulating properties, so that current cannot be carried from the hollow roller 3*a* to a casing (ground potential) of the fixing apparatus 50 through an unshown axis inserted into the end plates 28*a* and 28*b*.

Further, the thickness of the insulating members 26*a* and 26*b* provide gaps between the end portions of the hollow roller 3*a* and the belt flanges 25*a* and 25*b*. As a result, it is possible to obviate electrical conduction with reliability between the hollow roller 3*a* and the electroconductive layer of the fixing belt 1 even in the cases where the edge of the fixing belt 1 is locally bent by running against the belt flange 25*a* or 25*b*, where metal powder is deposited on portions adjacent to the belt flanges 25*a* and 25*b*, and where a length of the heat-shrinkable tube 27 is somewhat short. In the present invention, the electroconductive portion (hollow roller 3*a*) has an end surface which is electrically insulated at a position inside a regulation position at which the belt member (fixing belt 1) is regulated by the regulation portion (belt flange 25*a* or 25*b*).

As a result, it is possible to reliably prevent leakage of current from the fixing belt 1 and the nickel layer 1*a* (FIG. 6) of the fixing belt 1 to the casing (ground potential) of the fixing apparatus 50 even in the cases where the fixing belt 1 is electrically charged by continuously supplying the charged sheet S, where a voltage is induced in the fixing belt 1 by a high voltage supplied to the coils 4*a* and 4*b*, and where the eddy current by the magnetic flux from the coil 4*b* generates a potential at an end portion of the fixing belt 1. Further, as in the case of using metal-made belt flanges 25*a* and 25*b*, by the contact thereof with the edge of the fixing belt 1, it is possible to obviate such a phenomenon that eddy current carried between the belt flanges 25*a* and 25*b* and the nickel layer 1*a*

(FIG. 6) of the fixing belt 1 is generated to repeat passage and interruption of the eddy current due to unstable contact.

Further, the nickel layer 1*a* of the fixing belt 1 and the hollow roller 3*a* of the fixation tension roller 3 are separated from each other by the heat-shrinkable tube 27, so that the eddy current is generated with high reproducibility between the nickel layer 1*a* and the hollow roller 3*a*, thus obviating irregular heating due to repetition of unstable contact and noncontact states.

Second Embodiment

Figure 5:
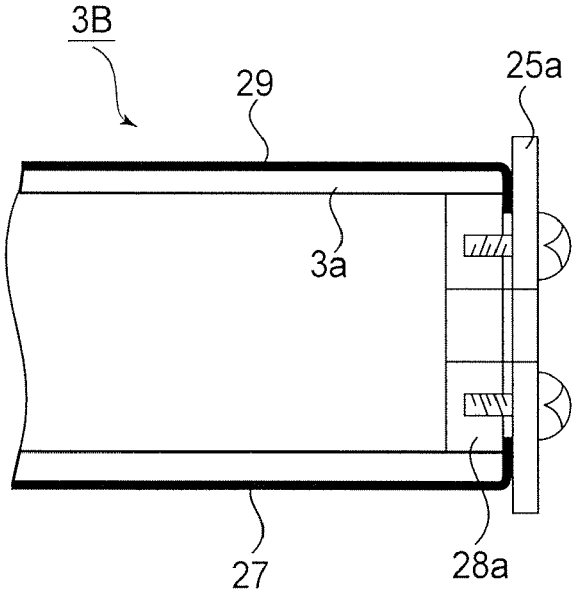
FIG. 5 is a schematic view for illustrating a structure of an end portion of a fixation tension roller in Second Embodiment.

FIG. 5 shows a structure of an end portion of a fixation tension roller 3B in Second Embodiment. As shown in FIG. 5, also in this embodiment similarly as in First Embodiment, belt flanges 25*a* and 25*b* are fixed at both end portions of the fixation tension roller 3B so that a position of the fixing belt 1 is prevented from being further outwardly deviated laterally. Into central openings of end plates 28*a* and 28*b*, a rotation axis (shaft) of the fixation tension roller 3 is fixedly inserted.

The belt flanges 25*a* and 25*b* are formed of a plastic member (material) having a heat resistance and sliding performance and set to have an outer diameter larger than that of the fixation tension roller 3B. They are rotated together with the fixation tension roller 3B. In FIG. 5, the belt flange 25*b* is not shown but is disposed at the other end portion of the fixation tension roller 3B.

In this embodiment, as shown in FIG. 5, a 50 μm-thick heat-shrinkable tube 29 (of PFA) is disposed in close contact with the outer peripheral surface of the fixation tension roller 3B while covering the surface and an edge thereof is interposed between the belt flange 25*a* (or 25*b* (not shown)) and the end plate 28*a* (or 28*b* (not shown) ). More specifically, the heat-shrinkable tube 29 is bent toward an axial center direction of the fixation tension roller 3*b* so as to sandwich the belt flange 25*a* (or 25*b* (not shown)) which is configured to be fastened by screws.

As a result, it is possible to realize resistance heating, with high reproducibility, such that passage of current between the nickel layer 1*a* (FIG. 6) of the fixing belt 1 and the pipe wall of the hollow roller 3*a* is obviated. Further, when the fixing belt 1 is laterally deviated, an edge of the fixing belt 1 contacts the fixing belt 25*a* or 25*b*. However, the belt flanges 25*a* and 25*b* have surface insulating properties, so that current cannot be carried from the hollow roller 3*a* to a casing (ground potential) of the fixing apparatus 50.

Further, the bent (interposed) portion of the heat-shrinkable tube 29 seals the end portions of the hollow roller 3*a* and the belt flanges 25*a* and 25*b*. As a result, it is possible to obviate electrical conduction with reliability between the hollow roller 3*a* and the electroconductive layer of the fixing belt 1 even in the cases where the edge of the fixing belt 1 is locally bent by running against the belt flange 25*a* or 25*b*, and where metal powder is deposited on portions adjacent to the belt flanges 25*a* and 25*b*.

As a result, it is possible to reliably prevent leakage of current from the fixing belt 1 to the casing (ground potential) of the fixing apparatus 50 even in the cases where the fixing belt 1 is electrically charged by continuously supplying the charged sheet S, where a voltage is induced in the fixing belt 1 by a high voltage supplied to the coils 4*a* and 4*b*, and where the eddy current by magnetic flux generates a potential at an end portion of the fixing belt 1.

<Induced Voltage of Fixing Belt>

Figure 7:
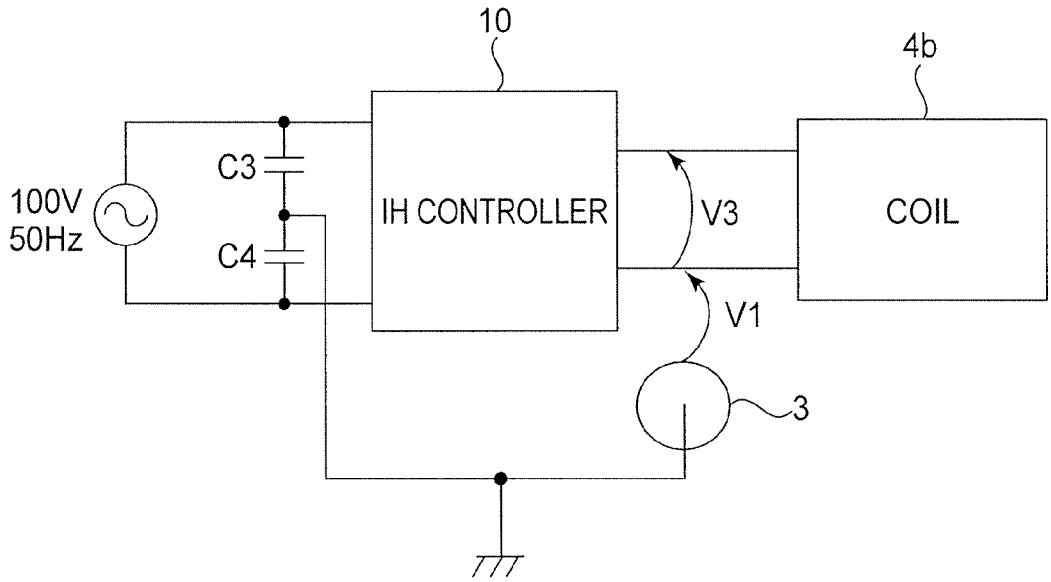
FIG. 7 is a circuit view showing a heat control system of a fixing belt.

FIGS. 6(*a*) and 6(*b*) are explanatory views of induced voltage of the fixing belt and FIG. 7 is a circuit diagram of a heat control system for the fixing belt. FIG. 6(*a*) is a cross-sectional view and FIG. 6(*b*) is an equivalent circuit. In the fixing apparatus 50 including the IH unit 4 disposed outside the fixing belt 1 as shown in FIG. 2, the fixing belt 1 which is an endless belt has an nickel layer 1*a* as a layer to be heated by induction heating and a silicone rubber layer 1*b* as an elastic layer disposed at an outer peripheral surface of the nickel layer 1*a* as shown in FIG. 6(*a*).

the coil 4*b* is disposed opposite to the fixing belt 1 via a spacing 4D, so that a distance d1 between the coil 4*b* and the nickel layer 1*a* is the sum of the spacing 4D and the thickness of the silicone rubber layer 1*b*. Further, a distance d2 between the hollow roller 3*a* of the fixation tension roller 3 and the nickel layer 1*a* is equal to a thickness of the heat-shrinkable tube 27.

An electrostatic capacity (capacitance) C created between two electrodes disposed with a spacing is generally represented by the following equation:

$$C=\in\times S/d,$$

wherein ∈ represents a dielectric constant, S represents an area of electrode, and d represents a distance between electrodes.

Based on the above equation, as shown in the equivalent circuit shown in FIG. 6(*b*), a capacitance C1 is created between the coil 4*b* and the nickel layer 1*a* as opposite two electrodes. Further, a capacitance C2 is created between the nickel layer 1*a* and the hollow roller 3*a*. The distance d1 between the nickel layer 1*a* of the fixing belt 1 and the coil 4*b* is larger, so that the capacitance C1 is a smaller value. On the other hand, the distance d2 between the nickel layer 1*a* and the hollow roller 3*a* is smaller, so that the capacitance C2 is a larger value.

Further, as shown in FIG. 7, when a high voltage is applied between terminals of the coil 4*b*, a voltage V1 applied to the coil 4*b* is caused to occur due to grounding (GND). At this time, a voltage V2 generated in the nickel layer 1*a* of the fixing belt 1 is represented by the following equation:

$$V2=V1\times C1/(C1+C2).$$

Here, strictly speaking, dielectric constants ∈ of the space, the rubber layer of the fixing belt, and the insulating heat-shrinkable tube (PFA) are different from each other. However, for simple evaluation, assuming that the dielectric constants ∈ are identical to each other and the areas S are also identical to each other, the voltage V2 is represented by the following equation:

$$V2=V1\times d2/(d1+d2).$$

For example, when d1=1 mm, d2=80 μm, and V1=(AC 600 V, 25 kHz), V2 is approximately 44 V (25 kHz).

This voltage V2 is generated between the nickel layer 1*a* of the fixing belt 1 and the GND of the fixing apparatus 50, so that when a part of the nickel layer 1 of the fixing belt 1 is brought near the hollow roller 3*a*, an electric field therebetween is large since the electric field is inversely proportional to the distance therebetween. As a result, electric discharge from the nickel layer 1*a* (end surface) of the fixing belt 1 to a portion, at the GND potential, of the fixation tension roller 3 (end surface) is caused to occur, thus producing noise.

In these circumstances, in the case where the belt flanges 25*a* and 25*b* are formed of metal and directly contact the hollow roller 4*a*, a problem such as leakage or the like arises every time the distance between the end surfaces of the fixing belt 1 and the belt flanges 25*a* and 25*b* is decreased even when an electrical insulating layer is disposed at both of the inner surface of the fixing belt 1 and the surface of the fixation tension roller 3. For this reason, the belt flanges were not capable of being employed in order to regulate movement of the fixing belt in the width direction.

The above described problem has been solved by the fixation tension rollers 3 and 3B in First Embodiment and Second Embodiment according to the present invention, so that a simple belt regulation system is realized in a belt fixation-type fixing apparatus employing an external IH method and an endless belt. More specifically, even in such a constitution that the endless belt is externally heated by the IH method and belt flanges are provided to one roller of a plurality of stretching means for stretching the endless belt to effect regulation of lateral movement of the endless belt, it is possible to carrying out the constitution by a simple belt without causing leakage of current from the end surface of the belt to the end surface of the roller as the stretching means.

Another Embodiment

The image heating apparatus according to the present invention is not limited to the fixing apparatuses described in the aforementioned embodiments but may also be effectively applicable to other image heating apparatuses such as a temporary fixing apparatus for temporarily fixing an unfixed image on a recording material (to be heated), and a surface modifying apparatus for modifying an image surface property such as gloss or the like by reheating a recording material on which a fixed image is carried.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 265420/2005 filed Sep. 13, 2005, which is hereby incorporated by reference.

What is claimed is:

1. An image heating apparatus comprising:

magnetic flux generation means for generating magnetic flux;

a rotatable belt member having an electroconductive layer for generating heat by magnetic flux from said magnetic flux generation means, said belt member heating an image on a recording material;

a metal roller, comprising an insulating layer at its surface, for supporting said belt member; and an insulating regulating member, provided to an end portion of said metal roller, for regulating movement of said belt member in an axial direction of said metal roller, wherein the insulating layer of said metal roller extends to an end surface of said metal roller and is disposed between a metal portion of said metal roller and said insulating regulating member at the end surface of said metal roller.

2. An apparatus according to claim 1, wherein said regulating member is provided at both end portions of said metal roller.

3. An apparatus according to claim 1, wherein said metal roller has a length in the direction that is longer than that of said belt member in the direction, and wherein said insulating layer is formed in the entire area of said metal roller.

4. An apparatus according to claim 1, wherein the electroconductive layer of said belt member generates heat by magnetic flux.

5. An apparatus according to claim 1, wherein said apparatus further comprises a nip forming member for forming a nip portion, contacting an inner surface of said belt member on which the recording material is nip conveyed.

6. An apparatus according to claim 1, wherein said magnetic flux generation means is provided oppositely to an outer surface of said belt member.

7. An apparatus according to claim 1, wherein said magnetic flux generation means includes a coil.

8. An apparatus according to claim 1, wherein said metal roller is disposed at a position opposite to said magnetic flux generation means through said belt member and generates heat by magnetic flux.

* * * * *